US008756764B2

(12) United States Patent
Daughtridge, Jr. et al.

(10) Patent No.: US 8,756,764 B2
(45) Date of Patent: Jun. 24, 2014

(54) REMOVABLE SIDE HINGE WITH TEMPORARY HOLDING FEATURE FOR A HOME APPLIANCE

(75) Inventors: Charles Daughtridge, Jr., New Bern, NC (US); Suad Elkasevic, Winterville, NC (US); Joseph Geiger, Trent Woods, NC (US); Philipp Wieser, Piding Bayern (DE)

(73) Assignee: BSH Home Appliances Corporation, Irvine, CA (US)

( * ) Notice: Subject to any disclaimer, the term of this patent is extended or adjusted under 35 U.S.C. 154(b) by 60 days.

(21) Appl. No.: 13/313,043

(22) Filed: Dec. 7, 2011

(65) Prior Publication Data

US 2013/0147334 A1 Jun. 13, 2013

(51) Int. Cl.
*E05D 5/00* (2006.01)
*E05D 7/10* (2006.01)

(52) U.S. Cl.
USPC ..... 16/382; 16/384; 16/387; 16/388; 16/268; 16/254

(58) Field of Classification Search
USPC ..... 16/382, 392, 389, 390, 391, 254, 271, 16/272, 258, 387, 365, 368, 369; 126/194, 126/192, 190, 191; 49/383, 381, 382, 389, 49/399; 312/325, 326, 313, 315
See application file for complete search history.

(56) References Cited

U.S. PATENT DOCUMENTS 3,123,064 A 3/1964 Hartson
3,124,121 A 3/1964 Baltz
3,869,753 A * 3/1975 Boback ..... 16/382
4,001,973 A 1/1977 Rice et al.
4,283,811 A * 8/1981 George ..... 16/390
5,067,200 A * 11/1991 Stowell et al. ..... 16/237
5,391,049 A * 2/1995 Reschlein ..... 414/795.3
5,472,271 A * 12/1995 Bowers et al. ..... 312/329
5,822,925 A 10/1998 McKinney et al.

(Continued)

FOREIGN PATENT DOCUMENTS

DE 202004003998 U1 6/2004
EP 2143861 A1 * 1/2010
WO WO 2005118995 A1 * 12/2005

OTHER PUBLICATIONS

Whirlpool Corporation: How do I remove the oven door on my gas range? Online Publication date 2011.

(Continued)

*Primary Examiner* — Chuck Mah
(74) *Attorney, Agent, or Firm* — James E. Howard; Andre Pallapies

(57) ABSTRACT

A hinge assembly for pivotably attaching a door to a home appliance includes a hinge bracket having a body; a hooking member that releasably engages a receiving feature of the home appliance; and a securing member fixed to the body. A fastener secures the securing member to the appliance in an operating position of the door and such that removal of the fastener releases the securing member from the home appliance so that the hooking member can be disengaged from the receiving feature to allow removal of the door from the home appliance, and the engagement of the hooking member with the receiving feature supports the weight of the door when the fastener is removed such that the receiving feature of the appliance supports the weight of the door to maintain a temporary vertical position of the door.

20 Claims, 8 Drawing Sheets

(56) References Cited

U.S. PATENT DOCUMENTS

| | | | | |
|---|---|---|---|---|
| 6,959,972 | B2 * | 11/2005 | Cude et al. | 312/329 |
| 2004/0034966 | A1 * | 2/2004 | Wegman | 16/254 |
| 2007/0193572 | A1 | 8/2007 | Lee | |
| 2009/0212677 | A1 * | 8/2009 | Kocak et al. | 312/326 |
| 2010/0295428 | A1 * | 11/2010 | Favaro et al. | 312/228 |

OTHER PUBLICATIONS

Blomberg International: Blomberg Ovens Online "Full Glass Door" Publication date 2011.

Blomberg International: Blomberg Ovens Online "Side-opening Door" Publication date 2011.

* cited by examiner

REMOVABLE SIDE HINGE WITH TEMPORARY HOLDING FEATURE FOR A HOME APPLIANCE

FIELD OF THE INVENTION

The invention is directed to a home appliance door hinge assembly having a temporary holding feature.

An example of an application for the invention is a hinge assembly for a side-swing door of a home appliance that allows the door to be unfastened from the home appliance while the hinge assembly supports the weight of the door.

BACKGROUND OF THE INVENTION

Many home appliances, such as built in ovens, have one or more doors that swing open about a vertical axis. The door is often heavy and requires substantial attachment of the hinges to the body of the appliance.

Such a door is preferably removable to allow installation separate from the appliance main body, repair, or replacement. Due to the substantial weight of the door, installation or removal can be difficult or even dangerous for one person. This is because it can be difficult to support the weight of the door while removing the fasteners that attach the door to the body of the appliance.

SUMMARY

The invention recognizes that it is desirable to provide a system for supporting the weight of the door while the door is installed or removed from the home appliance body.

Particular embodiments of the invention are directed to home appliance. The home appliance includes a home appliance body having a receiving feature; a door; and a hinge assembly that pivotably attaches the door to the home appliance body. The hinge assembly includes a hinge bracket having a body; a hooking member fixed to the hinge bracket body, the hooking member releasably engaging the receiving feature of the home appliance body; a securing member fixed to the hinge bracket body; and a fastener securing the securing member to the home appliance body while the hooking member is engaged with the receiving feature, the fastener being removable; and a first door bracket pivotably attached to the hinge bracket and fixed to the door. The fastener secures the securing member to the home appliance body in an operating position of the door such that the hinge bracket body is immovable relative to the receiving feature, the fastener is configured such that removal of the fastener releases the securing member from the home appliance body so that the hooking member can be disengaged from the receiving feature to allow removal of the door from the home appliance body, and the engagement of the hooking member with the receiving feature supports the weight of the door when the fastener is removed such that the receiving feature of the home appliance body supports the weight of the door to maintain a temporary vertical position of the door.

Other embodiments of the invention are directed to a hinge assembly for pivotably attaching a door to a home appliance. The hinge assembly includes a hinge bracket having a body; a hooking member fixed to the body, the hooking member being configured to releasably engage a receiving feature of the home appliance; a securing member fixed to the body; and a fastener configured to secure the securing member to the home appliance while the hooking member is engaged with the receiving feature, the fastener being removable; and a first door bracket pivotably attached to the hinge bracket and configured to be fixed to the door. The fastener is configured to secure the securing member to the home appliance in an operating position of the door such that the body is immovable relative to the receiving feature, the fastener is configured such that removal of the fastener releases the securing member from the home appliance so that the hooking member can be disengaged from the receiving feature to allow removal of the door from the home appliance, and the engagement of the hooking member with the receiving feature supports the weight of the door when the fastener is removed such that the receiving feature of the home appliance supports the weight of the door to maintain a temporary vertical position of the door.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

Figure 1:
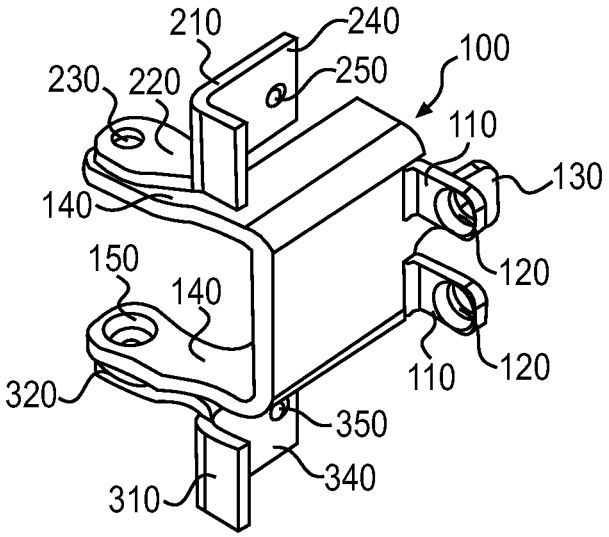
FIG. 1 is a perspective view of a hinge assembly in accordance with an exemplary embodiment of the invention.
Figure 2:
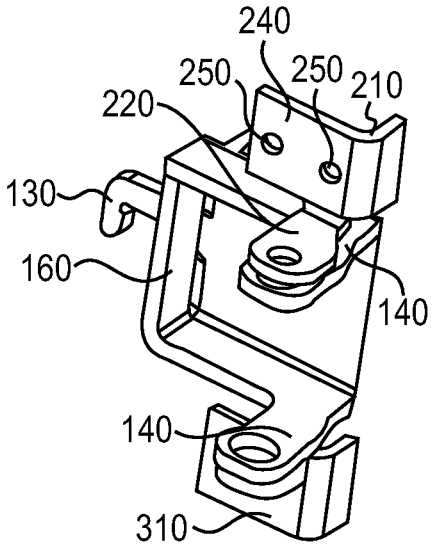
FIG. 2 is a perspective view of the hinge assembly of FIG. 1.
Figure 3:
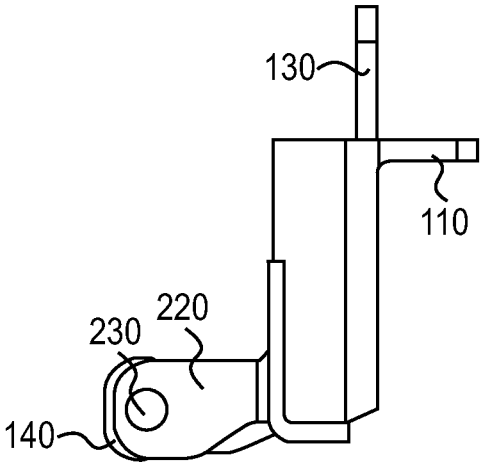
FIG. 3 is a top view of the hinge assembly of FIG. 1.
Figure 4:
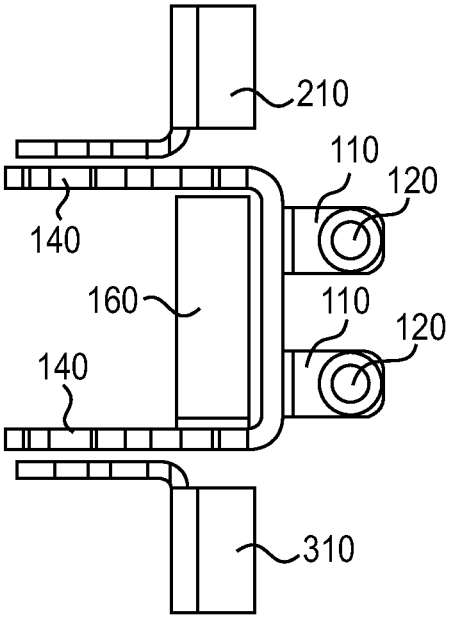
FIG. 4 is a front view of the hinge assembly of FIG. 1.
Figure 5:
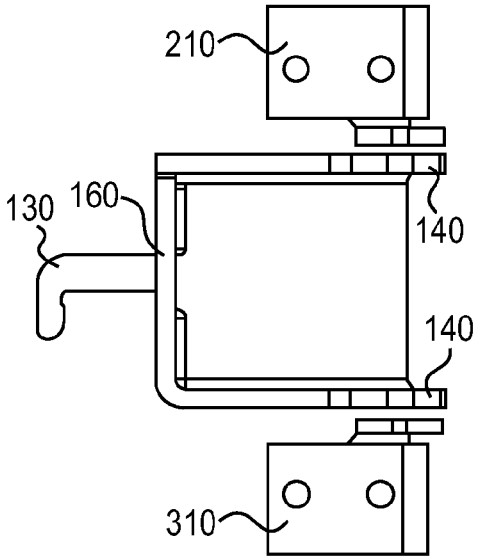
FIG. 5 is a side view of the hinge assembly of FIG. 1.
Figure 6:
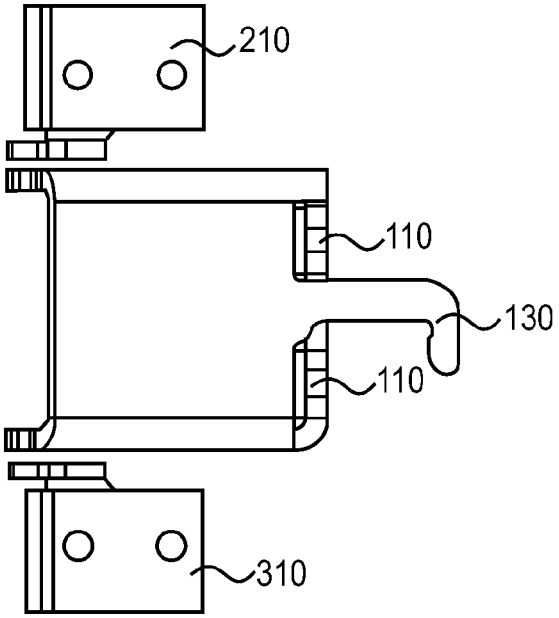
FIG. 6 is a side view of the hinge assembly of FIG. 1.
Figure 7:
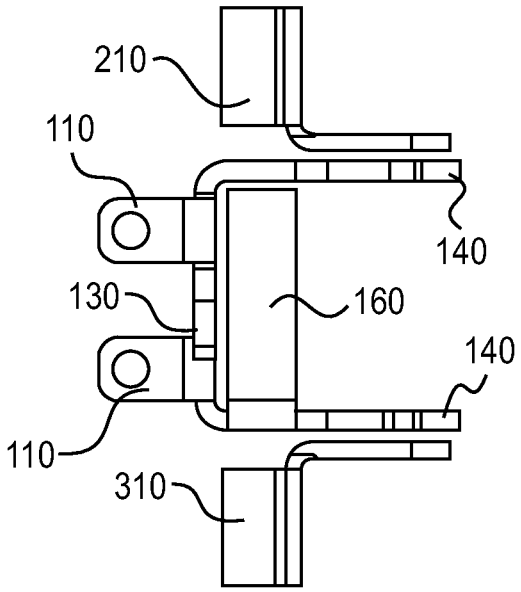
FIG. 7 is a rear view of the hinge assembly of FIG. 1.

The invention is described herein with reference to the accompanying drawings in which exemplary embodiments of the invention are shown. The invention may, however, be embodied in many different forms and should not be construed as limited to the embodiments set forth herein.

Many home appliances, such as, for example, built in ovens, have one or more side-swing doors that swing open about a vertical axis. These doors are often heavy and require substantial attachment of the hinges to the body of the appliance.

It is often preferable for the doors to be removable to allow installation separate from the appliance main body, repair, or replacement. Due to the substantial weight of the door, installation or removal can be difficult or even dangerous for one person. This is because it can be difficult to support the weight of the door while removing the fasteners that attach the door to the body of the appliance.

Embodiments of the invention provide a simple and safe way for one person to install or remove a door. This is achieved by providing a hooking feature on a hinge body. The hooking feature hooks in to a receiving feature on the appliance body to support the weight of the door while the more permanent fastening of the door to the appliance can be performed. In this application, the term "appliance body" can mean any part of the appliance including, but not limited to, a main body of the appliance, a frame of the appliance, or a cabinet or other framework into which the appliance is built.

FIGS. 1-7 show an example of a hinge assembly in accordance with an exemplary embodiment of the invention. The hinge assembly includes a hinge bracket 100, a top door bracket 210 and a bottom door bracket 310.

Top door bracket 210 and bottom door bracket 310 are configured to be fastened to a door of the home appliance. In this example, screws, bolts, or other fasteners fix a tab 240 of top door bracket 210 to the door through hole 250. Similarly, screws, bolts, or other fasteners fix a tab 340 of bottom door bracket 310 to the door through hole 350. Top door bracket 210 has a flange 220 that is pivotably attached to an upper flange 140 of hinge bracket 100. This attachment can be made with a rivet, shoulder bolt, or other pivoting attachment device. An example of an appropriate pivoting attachment is a rivet through a hole 230 in flange 220 and a hole 150 in upper flange 140. Similarly, a rivet can pivotably attach flange 320 to a lower flange 140 through a hole 330 and a hole 150. While this example has two door brackets 210, 310, other examples can have one door bracket, or three or more door brackets.

Hinge bracket 100 is secured to the appliance body by way of, in this example, two tabs 110. Each tab 110 has a hole 120 through which a fastener such as, for example, a screw or a bolt can secure hinge bracket 100 to the appliance body. In an operating position of the door, the door is fixed to top door bracket 210 and bottom door bracket 310 such that the door cannot move relative to top door bracket 210 and bottom door bracket 310. In the operating position of the door, hinge bracket 100 is fixed to the appliance body such that hinge bracket 100 cannot move relative to the appliance body. The pivoting movement of top door bracket 210 and bottom door bracket 310 relative to hinge bracket 100 permits the door to pivot relative to the appliance body. While this example has two tabs 110, other examples can have one tab 110, or three or more tabs 110.

Figure 9:
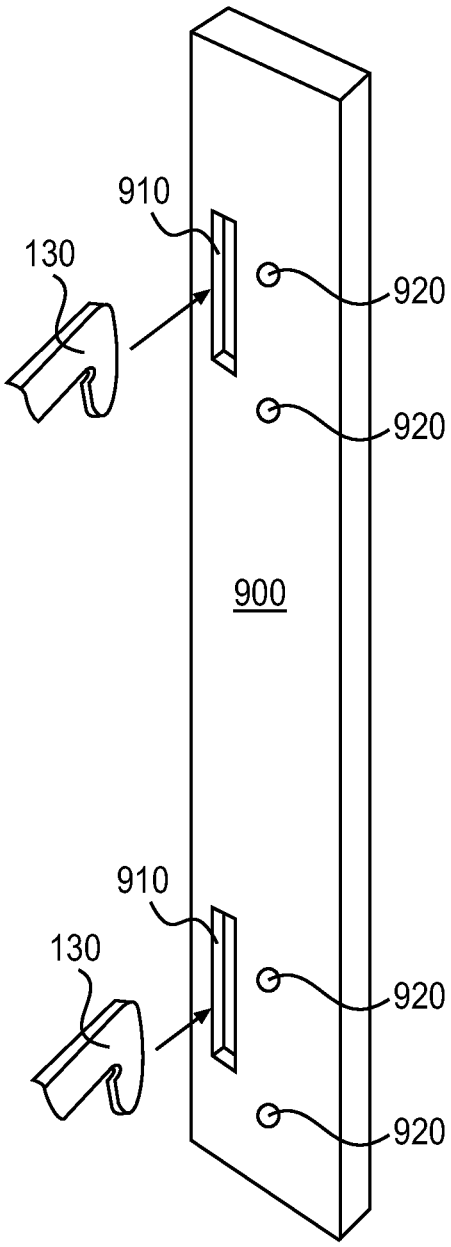
FIG. 9 is a partial perspective view of a hinge receiver in accordance with an exemplary embodiment of the invention.

Hinge bracket 100 has a hook 130 extending from it, in this example, adjacent to tabs 110. Hook 130 is configured to fit into a slot or other receiving feature of the appliance frame or body. FIG. 9 shows an example of a hinge receiver 900 that can be a frame or other part of the appliance. FIG. 9 shows two hooks 130, one on each of separate hinge brackets 100. The two hinge brackets 100 are fixed to an appliance door. Hooks 130 are guided into slots 910 in hinge receiver 900 as the door is moved toward the appliance. The operator can then allow the door to move downward under the force of gravity such that hooks 130 engage slots 910. In this position, hooks 130 prevent the door from falling away from the appliance while hinge brackets 100 are secured to the appliance by way of fasteners through holes 120 into holes 920 in hinge receiver 900. This configuration permits one operator to easily and safely mount the door to the appliance because hooks 130 support the weight of the door while hinge brackets 100 are secured to the appliance.

Figure 8:
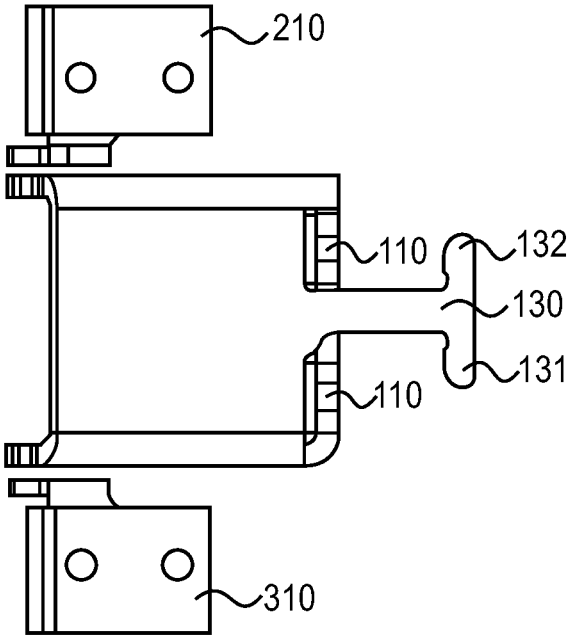
FIG. 8 is a side view of a variant of the hinge assembly of FIG. 1.

FIG. 8 shows an example of an embodiment having a hook 130 that has both an downward pointing finger 131 and a upward pointing finger 132. This embodiment can be used for a door mounted on either side of the appliance because in either mounting orientation one of the fingers 131, 132 will be pointing downward. The configuration of hinge bracket 100 shown in FIGS. 1-7 is appropriate for use on only one side of the appliance due to its hook 130 having only one finger.

Figure 10:
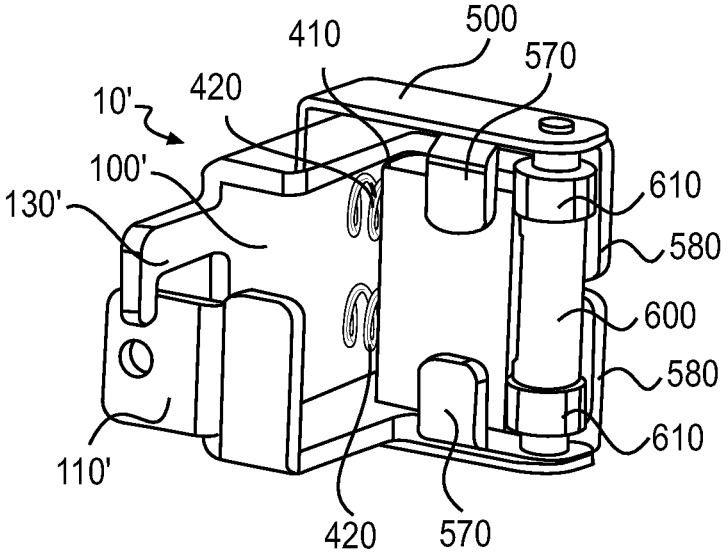
FIG. 10 is a perspective view of a hinge assembly in accordance with an exemplary embodiment of the invention.
Figure 11:
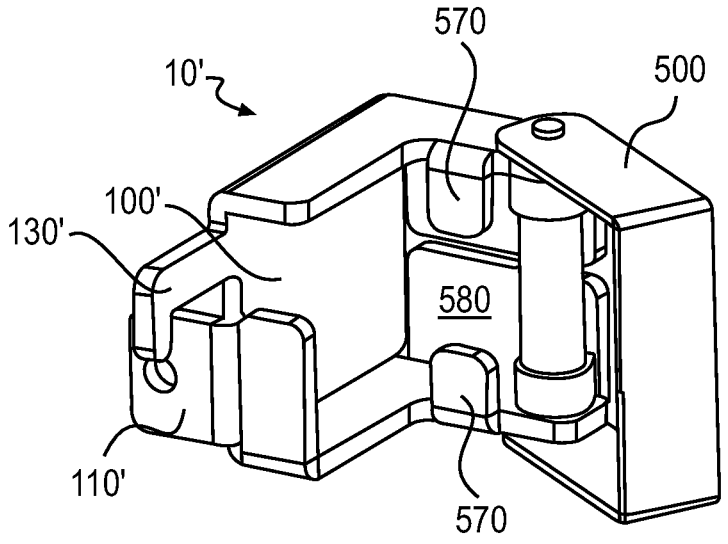
FIG. 11 is a perspective view of a hinge assembly in accordance with an exemplary embodiment of the invention.
Figure 12:
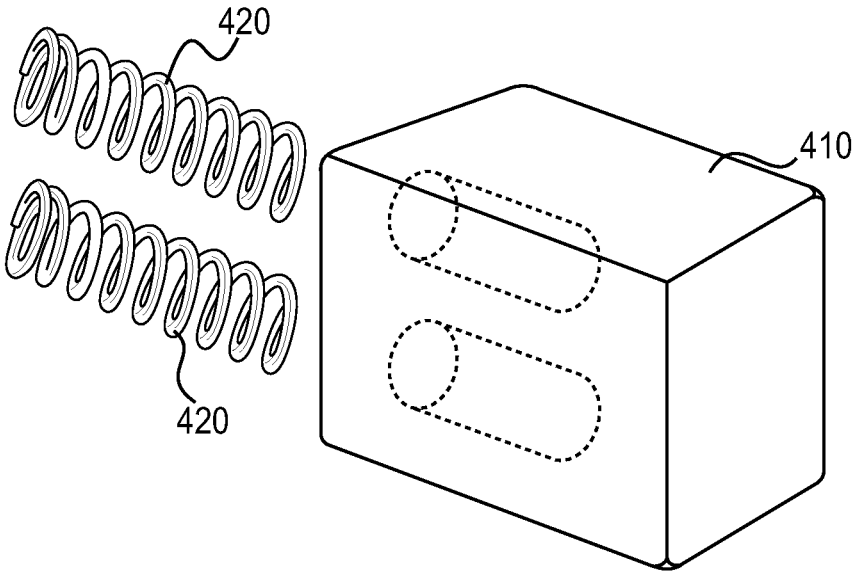
FIG. 12 is a perspective view of a haptics member in accordance with an exemplary embodiment of the invention.

FIGS. 10-12 show an example of an embodiment having a haptics feature that provides a different feel to different positions of the door. In this example, a hinge assembly 10' includes a hinge bracket 100', a door bracket 500 pivotably attached to hinge bracket 100', and a haptics body 410. As described below, haptics body 410 provides force on the pivoting motion of hinge bracket 100' relative to door bracket 500.

A pivot pin 600 connects door bracket 500 to hinge bracket 100' such that door bracket 500 can pivot relative to hinge bracket 100'. Pivot pin 600 has haptics cams 610 that rotate with pivot pin 600 when door bracket 500 pivots relative to hinge bracket 100'. As pivot pin 600 rotates, haptics cams 610 push on haptics body 410 and compress springs 420 against hinge bracket 100'. FIG. 10 shows hinge assembly 10' in a position in which the door is closed, and FIG. 11 shows hinge assembly 10' in a position in which the door is open. FIG. 11 shows hinge assembly 10' with haptics body 410 and springs 420 removed for clarity.

Similarly to hinge bracket 100 shown in FIGS. 1-7, hinge bracket 100' has a tab 110' for securing hinge bracket 100' to an appliance, and a hook 130'. Hinge bracket 100' has, in this example, a pair of tabs 570 and a pair of tabs 580 that hold haptics body 410 in place.

FIG. 12 shows springs 420 being inserted into voids in haptics body 410.

Figure 13:
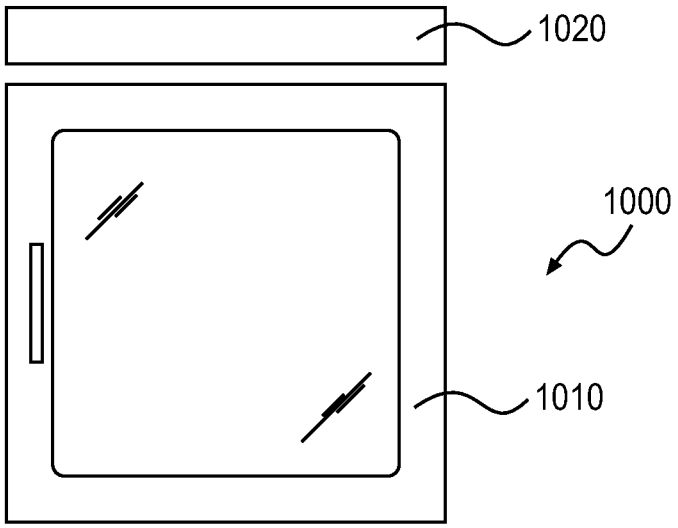
FIG. 13 is a front view of a home appliance in accordance with an exemplary embodiment of the invention.

FIG. 13 shows an example of an appliance 1000 having a door 1010 and a control panel 1020. Although this example shows an appliance with only one door, other examples have two or more doors.

Figure 14:
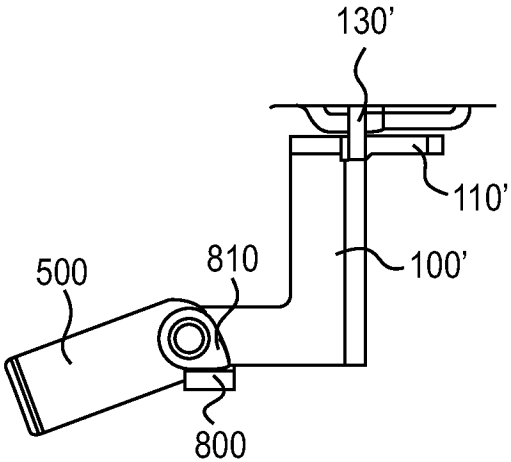
FIG. 14 is a top view of a hinge assembly in accordance with an exemplary embodiment of the invention in an open position.
Figure 15:
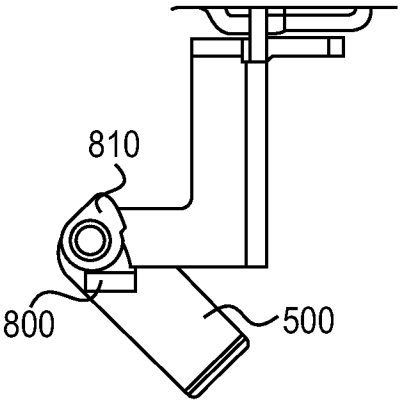
FIG. 15 is a top view of a hinge assembly in accordance with an exemplary embodiment of the invention in a 45 degree position.
Figure 16:
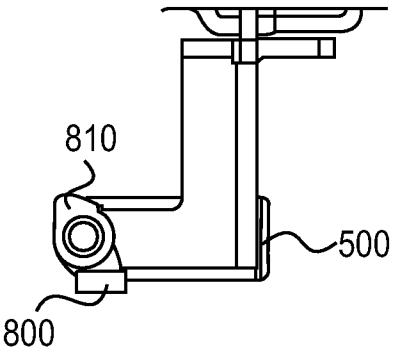
FIG. 16 is a top view of a hinge assembly in accordance with an exemplary embodiment of the invention in a closed position.

FIGS. 14-16 show an example of an embodiment having a door swing limiting feature. Hinge assembly 10' of FIGS. 10-12 is used to explain this feature, but the feature can be applied to other hinge assembly embodiments. FIGS. 14-16 are top views of door bracket 500 pivoting relative to hinge bracket 100'. A stopper flange 800 is fixed relative to hinge bracket 100'. A stopper 810 is fixed relative to door bracket 500. As door bracket 500 (and the door) pivots from a closed position (FIG. 16) to a full open position (FIG. 14), stopper 810 moves with door bracket 500. In the full open position shown in FIG. 14, stopper 810 contacts stopper flange 800 and prevents door bracket 500 (and the door) from pivoting any further.

The door swing limiting feature can also be effected by, for example, providing a bump or protrusion on the hinge bracket that interferes with the pivoting of the door bracket, or providing a bump or protrusion on the door bracket that interferes with the relative pivoting of the hinge bracket.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the invention.

What is claimed is:

1. A home appliance, comprising:

a home appliance body having a receiving feature;

a door; and a hinge assembly that pivotably attaches the door to the home appliance body, the hinge assembly comprising:

a hinge bracket having a body;

a hooking member fixed to the hinge bracket body, the hooking member releasably engaging the receiving feature of the home appliance body;

a securing member fixed to the hinge bracket body; and a fastener securing the securing member to the home appliance body while the hooking member is engaged with the receiving feature, the fastener being removable; and a first door bracket pivotably attached to the hinge bracket and fixed to the door, wherein the fastener secures the securing member to the home appliance body in an operating position of the door such that the hinge bracket body is immovable relative to the receiving feature, the fastener is configured such that removal of the fastener releases the securing member from the home appliance body so that the hooking member can be disengaged from the receiving feature to allow removal of the door from the home appliance body, the engagement of the hooking member with the receiving feature supports the weight of the door when the fastener is removed such that the receiving feature of the home appliance body supports the weight of the door to maintain a temporary vertical position of the door, and the hooking member has a main section that protrudes from the hinge bracket body, a first finger that extends substantially perpendicularly from the main section, and a second finger that extends substantially perpendicularly from the main section and in substantially an opposite direction from the first finger.

2. The home appliance of claim 1, further comprising a second door bracket pivotably attached to the hinge bracket and configured to be fixed to the door.

3. The home appliance of claim 2, wherein the first door bracket is pivotably attached to the hinge bracket by a rivet.

4. The home appliance of claim 1, wherein the first door bracket is pivotably attached to the hinge bracket by a pivot pin.

5. The home appliance of claim 4, further comprising a haptics member in contact with the hinge bracket and the pivot pin such that pivoting movement of the first door bracket relative to the hinge bracket causes the haptics member to act on the pivot pin to provide varying amounts of resistance to the pivoting movement of the first door bracket relative to the hinge bracket.

6. The home appliance of claim 5, wherein the pivot pin include a cam surface.

7. The home appliance of claim 6, wherein the haptics member includes a spring that urges a face of the haptics member against the cam surface.

8. The home appliance of claim 1, further comprising a pivot pin that pivotably attaches the first door bracket to the hinge bracket; and a haptics member in contact with the hinge bracket and the pivot pin such that pivoting movement of the first door bracket relative to the hinge bracket causes the haptics member to act on the pivot pin to provide varying amounts of resistance to the pivoting movement of the first door bracket relative to the hinge bracket.

9. The home appliance of claim 1, further comprising a swing limiting feature that limits the pivoting of the first door bracket relative to the hinge bracket, the swing limiting feature including a stop member on the first door bracket or the hinge bracket; and an abutment surface on the other of the first door bracket or the hinge bracket, wherein the stop member contacts the abutment surface at a maximum open position of the door.

10. The home appliance of claim 1, wherein the receiving feature is a slot in the home appliance body.

11. A hinge assembly for pivotably attaching a door to a home appliance, the hinge assembly comprising:

a hinge bracket having a body;

a hooking member fixed to the body, the hooking member being configured to releasably engage a receiving feature of the home appliance;

a securing member fixed to the body; and a fastener configured to secure the securing member to the home appliance while the hooking member is engaged with the receiving feature, the fastener being removable; and a first door bracket pivotably attached to the hinge bracket and configured to be fixed to the door, wherein the fastener is configured to secure the securing member to the home appliance in an operating position of the door such that the body is immovable relative to the receiving feature, the fastener is configured such that removal of the fastener releases the securing member from the home appliance so that the hooking member can be disengaged from the receiving feature to allow removal of the door from the home appliance, the engagement of the hooking member with the receiving feature supports the weight of the door when the fastener is removed such that the receiving feature of the home appliance supports the weight of the door to maintain a temporary vertical position of the door, and the hooking member has a main section that protrudes from the body of the hinge bracket, a first finger that extends substantially perpendicularly from the main section, and a second finger that extends substantially perpendicularly from the main section and in substantially an opposite direction from the first finger.

12. The assembly of claim 11, further comprising a second door bracket pivotably attached to the hinge bracket and configured to be fixed to the door.

13. The assembly of claim 12, wherein the first door bracket is pivotably attached to the hinge bracket by a rivet.

14. The assembly of claim 11, wherein the first door bracket is pivotably attached to the hinge bracket by a pivot pin.

15. The assembly of claim 14, further comprising a haptics member in contact with the hinge bracket and the pivot pin such that pivoting movement of the first door bracket relative to the hinge bracket causes the haptics member to act on the pivot pin to provide varying amounts of resistance to the pivoting movement of the first door bracket relative to the hinge bracket.

16. The assembly of claim 15, wherein the pivot pin include a cam surface.

17. The assembly of claim 16, wherein the haptics member includes a spring that urges a face of the haptics member against the cam surface.

18. The assembly of claim 11, further comprising a pivot pin that pivotably attaches the first door bracket to the hinge bracket; and a haptics member in contact with the hinge bracket and the pivot pin such that pivoting movement of the first door bracket relative to the hinge bracket causes the haptics member to act on the pivot pin to provide varying amounts of resistance to the pivoting movement of the first door bracket relative to the hinge bracket.

19. The assembly of claim 11, further comprising a swing limiting feature that limits the pivoting of the first door bracket relative to the hinge bracket, the swing limiting feature including a stop member on the first door bracket or the hinge bracket; and an abutment surface on the other of the first door bracket or the hinge bracket, wherein the stop member contacts the abutment surface at a maximum open position of the door bracket relative to the hinge bracket.

20. The assembly of claim 11, wherein the receiving feature is a slot in a body of the home appliance.

* * * * *